US008000967B2

(12) United States Patent
Taleb

(10) Patent No.: US 8,000,967 B2
(45) Date of Patent: Aug. 16, 2011

(54) LOW-COMPLEXITY CODE EXCITED LINEAR PREDICTION ENCODING

(75) Inventor: Anisse Taleb, Kista (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 1039 days.

(21) Appl. No.: 11/074,928

(22) Filed: Mar. 9, 2005

(65) Prior Publication Data

US 2006/0206319 A1 Sep. 14, 2006

(51) Int. Cl.
*G10L 13/00* (2006.01)

(52) U.S. Cl. ..... 704/264; 704/222; 704/223; 704/221

(58) Field of Classification Search ..... 704/222, 704/223, 264, 221
See application file for complete search history.

(56) References Cited

U.S. PATENT DOCUMENTS

| | | | | |
|---|---|---|---|---|
| 6,041,297 | A * | 3/2000 | Goldberg | 704/219 |
| 6,122,338 | A | 9/2000 | Yamauchi | |
| 6,161,086 | A * | 12/2000 | Mukherjee et al. | 704/207 |
| 6,192,334 | B1 | 2/2001 | Nomura | |
| 6,393,392 | B1 * | 5/2002 | Minde | 704/220 |
| 2003/0191635 | A1 | 10/2003 | Minde et al. | |
| 2004/0044524 | A1 | 3/2004 | Minde et al. | |
| 2004/0109471 | A1 | 6/2004 | Minde et al. | |
| 2006/0206319 | A1 * | 9/2006 | Taleb | 704/223 |

FOREIGN PATENT DOCUMENTS

| | | | |
|---|---|---|---|
| EP | 0 855 699 | A2 | 7/1998 |
| EP | 0 869 477 | A2 | 10/1998 |
| EP | 0 890 943 | A2 | 1/1999 |
| JP | 10-097295 | A | 4/1998 |
| JP | 10-105193 | A | 4/1998 |
| JP | 10-207496 | A | 8/1998 |
| JP | 10-282997 | A | 10/1998 |
| JP | 11-030997 | A | 2/1999 |
| JP | 2004-302259 | A | 10/2004 |
| WO | 96/28810 | A1 | 9/1996 |

OTHER PUBLICATIONS

3GPP TS 26.190 V5.1.0 (Dec. 2001) Tech. Spec., 3rd Generation Partnership Project; Technical Specification Group Services and System Aspects; Speech Codec Speech Processing Functions; AMR Wideband Speech Codec; Transcoding Functions (Release 5).
Recommendation ITU-R BS.1387-1, "Method for Objective Measurements of Perceived Audio Quality", 1998-2001.

(Continued)

*Primary Examiner* — Jakieda R Jackson
(74) *Attorney, Agent, or Firm* — Nixon & Vanderhye, P.C.

(57) ABSTRACT

Information about excitation signals of a first signal encoded by CELP is used to derive a limited set of candidate excitation signals for a second correlated second signal. Preferably, pulse locations of the excitation signals of the first encoded signal are used for determining the set of candidate excitation signals. More preferably, the pulse locations of the set of candidate excitation signals are positioned in the vicinity of the pulse locations of the excitation signals of the first encoded signal. The first and second signals may be multichannel signals of a common speech or audio signal. However, the first and second signals may also be identical, whereby the coding of the second signal can be utilized for re-encoding at a lower bit rate.

36 Claims, 11 Drawing Sheets

OTHER PUBLICATIONS

Ramprashad, "Stereophonic CELP Coding Using Cross Channel Prediction", in Proc. IEEE Workshop Speech Coding, Sep. 2000, pp. 136-138.

Fuchs, "Improving Joint Stereo Audio Coding by Adaptive Inter-Channel Prediction", in Proc. IEEE WASPAA, Mohonk, NY, Oct. 1993.

Liebschen, "Lossless Audio Coding Using Adaptive Multichannel Prediction", in Proc. AES 113$^{th}$ Conv., Los Angeles, CA, Oct. 2002.

English translation of Chinese Office Action mailed May 25, 2010 in corresponding Chinese Application 200580048981.6.

* cited by examiner

LOW-COMPLEXITY CODE EXCITED LINEAR PREDICTION ENCODING

TECHNICAL FIELD

The present invention relates in general to audio coding, and in particular to code excited linear prediction coding.

BACKGROUND

Existing stereo, or in general multi-channel, coding techniques require a rather high bit-rate. Parametric stereo is often used at very low bit-rates. However, these techniques are designed for a wide class of generic audio material, i.e. music, speech and mixed content.

In multi-charnel speech coding, very little has been done. Most work has focused on an inter-channel prediction (ICP) approach. ICP techniques utilize the fact that there is correlation between a left and a right channel. Many different methods that reduce this redundancy in the stereo signal are described in the literature, e.g. in [1][2][3].

The ICP approach models quite well the case where there is only one speaker, however it fails to model multiple speakers and diffuse sound sources (e.g. diffuse background noises). Therefore, encoding a residual of ICP is a must in several cases and puts quite high demands on the required bit-rate.

Most existing speech codes are monophonic and are based on the code-excited linear predictive (CELP) coding model. Examples include AMR-NB and AMR-WB (Adaptive Multi-Rate Narrow Band and Adaptive Multi-Rate Wide Band). In this model, i.e. CELP, an excitation signal at an input of a short-term LP syntheses filter is constructed by adding two excitation vectors from adaptive and fixed (innovative) codebooks, respectively. The speech is synthesized by feeding the two properly chosen vectors from these codebooks through the short-term synthesis filter. The optimum excitation sequence in a codebook is chosen using an analysis-by-synthesis search procedure in which the error between the original and synthesized speech is minimized according to a perceptually weighted distortion measure.

There are two types of fixed codebooks. A first type of codebook is the so-called stochastic codebooks. Such a codebook often involves substantial physical storage. Given the index in a codebook, the excitation vector is obtained by conventional table lookup. The size of the codebook is therefore limited by the bit-rate and the complexity.

A second type of codebook is an algebraic codebook. By contrast to the stochastic codebooks, algebraic codebooks are not random and require virtually no storage. An algebraic codebook is a set of indexed code vectors whose amplitudes and positions of the pulses constituting the $k^{th}$ code vector are derived directly from the corresponding index k. This requires virtually no memory requirements. Therefore, the size of algebraic codebooks is not limited by memory requirements. Additionally, the algebraic codebooks are well suited for efficient search procedures.

It is important to note that a substantial and often also major part of the speech codec available bits are allocated to the fixed codebook excitation encoding. For instance, in the AMR-WB standard, the amount of bits allocated to the fixed codebook procedures ranges from 36% up to 76%. Additionally, it is the fixed codebook excitation search that represents most of the encoder complexity.

In [7], a multi-part fixed codebook including an individual fixed codebook for each channel and a shared codebook common to all channels is used. With this strategy it is possible to have a good representation of the inter-channel correlations. However, this comes at an extent of increased complexity as well as storage. Additionally, the required bit rate to encode the fixed codebook excitations is quite large because in addition to each channel codebook index one needs also to transmit the shared codebook index. In [8] and [9], similar methods for encoding multi-channel signals are described where the encoding mode is made dependent on the degree of correlation of the different channels. These techniques are already well known from Left/Right and Mid/Side encoding, where switching between the two encoding modes is dependent on a residual, thus dependent on correlation.

In [10], a method for encoding multichannel signals is described which generalizes different elements of a single channel linear predictive codec. The method has the disadvantage of requiring an enormous amount of computations rendering it unusable in real-time applications such as conversational applications. Another disadvantage of this technology is the amount of bits needed in order to encode the various decorrelation filters used for encoding.

Another disadvantage with the previously cited solutions described above is their incompatibility towards existing standardized monophonic conversational codecs, in the sense that no monophonic signal is separately encoded thus prohibiting the ability to directly decode a monophonic only signal.

SUMMARY

A general problem with prior art speech coding is that it requires high bit rates and complex encoders.

A general object of the technology disclosed herein is thus to provide improved methods and devices for speech coding. A subsidiary object of the technology disclosed herein is to provide CELP methods and devices having reduced requirement in terms of bit rates and encoder complexity.

In general words, excitation signals of a first signal encoded by CELP are used to derive a limited set of candidate excitation signals for a second signal. Preferably, the second signal is correlated with the first signal. In a particular example embodiment, the limited set of candidate excitation signals is derived by a rule, which was selected from a predetermined set of rules based on the encoded first signal and/or the second signal. Preferably, pulse locations of the excitation signals of the first encoded signal are used for determining the set of candidate excitation signals. More preferably, the pulse locations of the set of candidate excitation signals are positioned in the vicinity of the pulse locations of the excitation signals of the first encoded signal. The first and second signals may be multi-channel signals of a common speech or audio signal. However, the first and second signals may also be identical, whereby the coding of the second signal can be utilized for re-encoding at a lower bit rate.

One advantage of the technology disclosed herein is that the coding complexity is reduced. Furthermore, in the case of multi-channel signals, the required bit rate for transmitting coded signals is reduced. Also, the technology disclosed herein may be efficiently applied to re-encoding the same signal at a lower rate. Another advantage of the technology disclosed herein is the compatibility with mono signals and the possibility to be implemented as an extension to existing speech codecs with very few modifications.

BRIEF DESCRIPTION OF THE DRAWINGS

The invention, together with further objects and advantages thereof, may best be understood by making reference to the following description taken together with the accompanying drawings, in which.

DETAILED DESCRIPTION

Figure 1A:
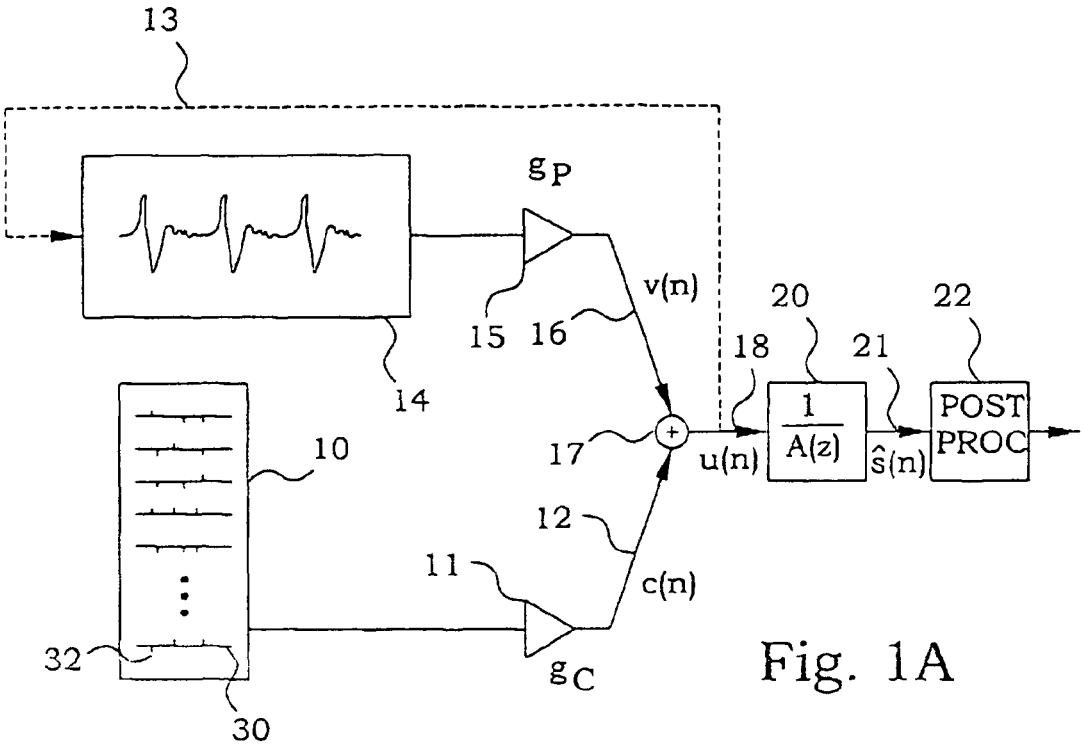
FIG. 1A is a schematic illustration of a code excited linear prediction model.

A general CELP speech synthesis model is depicted in FIG. 1A. A fixed codebook 10 comprises a number of candidate excitation signals 30, characterized by a respective index k. In the case of an algebraic codebook, the index k alone characterizes the corresponding candidate excitation signal 30 completely. Each candidate excitation signal 30 comprises a number of pulses 32 having a certain position and amplitude. An index k determines a candidate excitation signal 30 that is amplified in an amplifier 11 giving rise to an output excitation signal $c_k(n)$ 12. An adaptive codebook 14, which is not the primary subject of the technology disclosed herein, provides an adaptive signal v(n), via an amplifier 15. The excitation signal $c_k(n)$ and the adaptive signal v(n) are summed in an adder 17, giving a composite excitation signal u(n).The composite excitation signal u(n) influences the adaptive codebook for subsequent signals, as indicated by the dashed line 13.

The composite excitation signal u(n) is used as input signal to a transform 1/A(z) in a linear prediction synthesis section 20, resulting in a "predicted" signal $\hat{s}(n)$ 21, which, typically after post-processing 22, is provided as the output from the CELP synthesis procedure.

The CELP speech synthesis model is used for analysis-by-synthesis coding of the speech signal of interest. A target signal s(n), i.e. the signal that is going to be resembled is provided. A long-term prediction is made by use of the adaptive codebook, adjusting a previous coding to the present target signal, giving an adaptive signal $v(n)=g_p u(n-\delta)$. The remaining difference is the target for the fixed codebook excitation signal, whereby a codebook index k corresponding to an entry $c_k$ should minimize the difference according to typically an objective function, e.g. a mean square measure. In general, the algebraic codebook is searched by minimizing the mean square error between the weighted input speech and the weighted synthesis speech. The fixed codebook search, aims to find the algebraic codebook entry $c_k$ corresponding to index k, such that $$Q_k = \frac{(y_z^T H c_k)^2}{c_k^T H^T H c_k},$$

is maximized. The matrix H is a filtering matrix whose elements are derived from the impulse response of a weighting filter. $y_2$ is a vector of components which are dependent on the signal to be encoded.

Figure 1B:
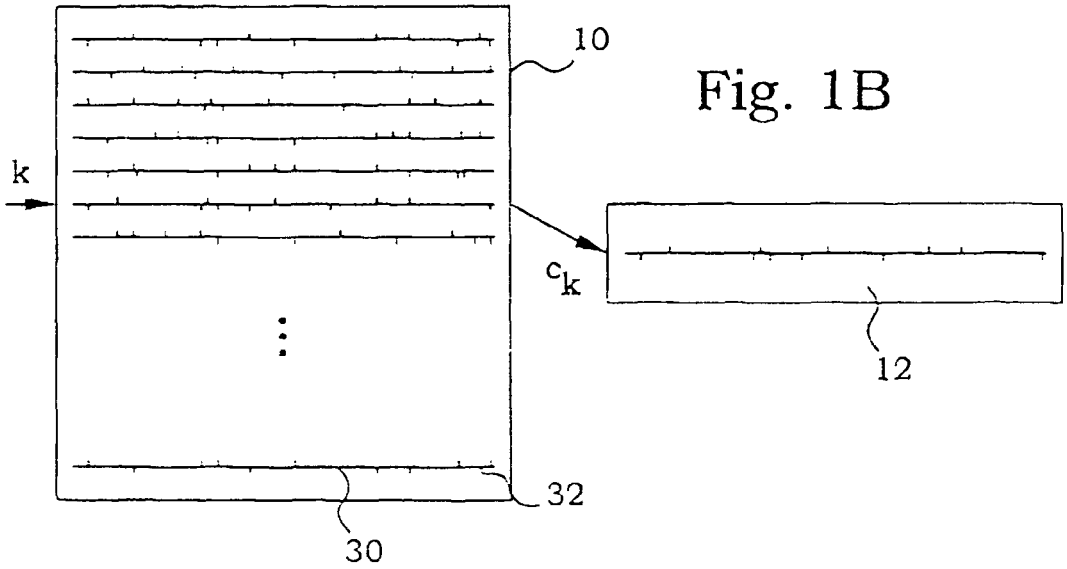
FIG. 1B is a schematic illustration of a process of deriving an excitation signal.

This fixed codebook procedure can be illustrated as in FIG. 1B, where an index k selects an entry $c_k$ from the fixed codebook 10 as excitation signal 12. In a stochastic fixed codebook, the index k typically serves as an input to a table look-up, while in an algebraic fixed codebook, the excitation signal 12 are derived directly from the index k. In general the multi-pulse excitation can be written as:

$$c_k(n) = \sum_{i=1}^{P} b_{i,k}\,\delta(n - p_{i,k}),$$

Where $p_{i,k}$ are the pulses positions for index k, while $b_{i,k}$ are the individual pulses amplitudes and P is the number of pulses and δ is the Dirac pulse function:

$$\delta(0)=1,\ \delta(n)=0 \text{ for } n\neq 0.$$

Figure 1C:
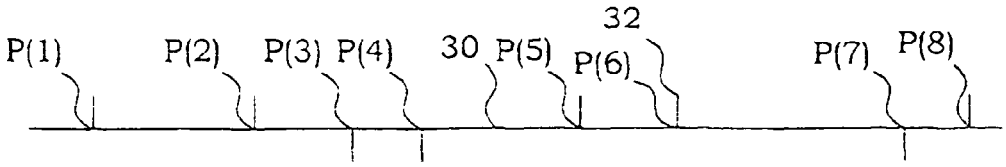
FIG. 1C is a schematic illustration of an embodiment of an excitation signal for use in a code excited linear prediction model.

FIG. 1C illustrates an example of a candidate excitation signal 30 of the fixed codebook 10. The candidate excitation signal 30 is characterized by a number of pulses 32, in this example 8 pulses. The pulses 32 are characterized by their position P(1)-P(8) and their amplitude, which in a typical algebraic fixed codebook is either +1 or −1.

Figure 2:
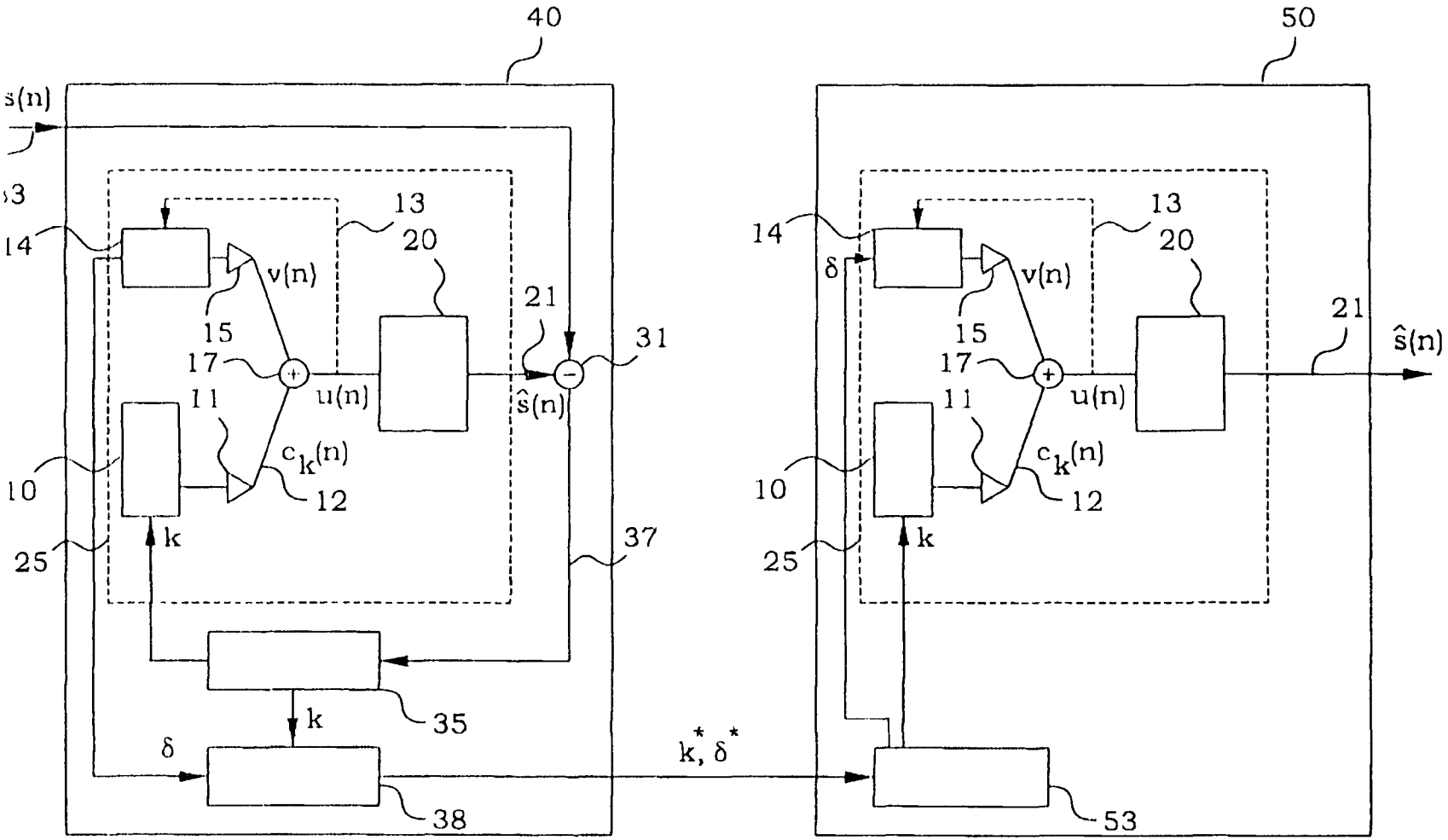
FIG. 2 is a block scheme of an embodiment of an encoder and decoder according to the code excited linear prediction model.

In an encoder/decoder system for a single channel, the CELP model is typically implemented as illustrated in FIG. 2. The different parts corresponding to the different functions of the CELP synthesis model of FIG. 1A are given the same reference numbers, since the parts mainly are characterized by their function and typically not in the same degree by their actual implementation. For instance, error weighting filters, usually present in an actual implementation of a linear prediction analysis by synthesis are not represented.

A signal to be encoded s(n) 33 is provided to an encoder unit 40. The encoder unit comprises a CELP synthesis block 25 according to the above discussed principles. (Post-processing is omitted in order to facilitate the reading of the figure.) The output from the CELP synthesis block 25 is compared with the signal s(n) in a comparator block 31. A difference 37, which may be weighted by a weighting filter, is provided to an codebook optimization block 35, which is arranged according to any prior-art principles to find an optimum or at least reasonably good excitation signal $c_k(n)$ 12. The codebook optimization block 35 provides the fixed codebook 10 with the corresponding index k. When the final excitation signal is found, the index k and the delay δ of the adaptive codebook 12 are encoded in an index encoder 38 to provide an output signal 45 representing the index k and the delay δ.

The representation of the index k and the delay δ is provided to a decoder unit 50. The decoder unit comprises a CELP synthesis block 25 according to the above discussed principles. (Post-processing is also here omitted in order to facilitate the reading of the figure.) The representation of index k and delay δ are decoded in an index decoder 53, and index k and delay δ are provided as input parameters to the fixed codebook and the adaptive code, respectively, resulting in a synthesized signal ŝ(n) 21, which is supposed to resemble the original signal s(n).

The representation of the index k and the delay δ can be stored for a shorter or longer time anywhere between the encoder and decoder, enabling e.g. audio recordings storing requiring relatively small storing capability.

The technology disclosed herein is related to speech and in general audio coding. In a typical case, it deals with cases where a main signal $s_M(n)$ has been encoded according to the CELP technique and the desire is to encode another signal $s_S(n)$. The other signal could be the same main signal $s_S(n)=s_M(n)$, e.g. during re-encoding at a lower bit rate, or an encoded version of the main signal $s_S(n)=s_M(n)$, or a signal corresponding to another channel, e.g. stereo, multi-channel 5.1, etc.

The technology disclosed herein is thus directly applicable to stereo and in general multi-channel coding for speech in teleconferencing applications. The application of the technology disclosed herein can also include audio coding as part of an open-loop or closed-loop content dependent encoding.

There should preferably exist a correlation between the main signal and the other signal, in order for the technology disclosed herein to operate in optimal conditions. However, the existence of such correlation is not a mandatory requirement for the proper operation of the technology disclosed herein. In fact, the technology disclosed herein can be operated adaptively and made dependent on the degree of correlation between the main signal and the other signal. Since there exist no causal relationship between a left and right channel in stereo applications, the main signal $s_M(n)$ is often chosen as the sum signal and $s_S(n)$ as the difference signal of the left and right channels.

A presumption of the technology disclosed herein is that the main signal $s_M(n)$ is available in a CELP encoded representation. One basic idea of the technology disclosed herein is to limit the search in the fixed codebook during the encoding of the other signal $s_S(n)$ to a subset of candidate excitation signals. This subset is selected dependent on the CELP encoding of the main signal. In a preferred example embodiment, the pulses of the candidate excitation signals of the subset are restricted to a set of pulse positions that are dependent on the pulse positions of the main signal. This is equivalent to defining constrained candidate pulse locations. The set of available pulse positions can typically be set to the pulse positions of the main signal plus neighboring pulse positions.

This reduction of the number of candidate pulses reduces dramatically the computational complexity of the encoder.

Below, an illustrative example is given for the general case of two channel signals. However, this is easily extended to multiple channels. However, in the case of multiple channels, the target may be different given different weighting filters on each channel, but also the targets on each channels may be delayed with respect to each other.

A main channel and a side channel can be constructed by $$s_M(n) = \frac{s_L(n) + s_R(n)}{2}$$

$$s_S(n) = \frac{s_L(n) - s_R(n)}{2}$$

where $s_L(n)$ and $s_R(n)$ are the input of the left and right channel respectively. One can clearly see that even if the left and right channel were a delayed version of each other, then this would not be the case for the main and the side channel, since in general these would contain information from both channels.

In the following, it is assumed that the main channel is the first encoded channel and that the pulses locations for the fixed codebook excitation for that encoding are available.

The target for the side signal fixed codebook excitation encoding is computed as the difference between the side signal and the adaptive codebook excitation:

$$s_C(n)=s_S(n)-g_P v(n),\ n=0,\ldots,L-1,$$

where $g_P v(n)$ is the adaptive codebook excitation and $s_C(n)$ is the target signal for adaptive codebook search.

In the present embodiment, the number of potential pulse positions of the candidate excitation signals are defined relative to the main signal pulse positions. Since they are only a fraction of all possible positions, the amount of bits required for encoding the side signal with an excitation signal within this limited set of candidate excitation signals is therefore largely reduced, compared with the case where all pulse positions may occur.

The selection of the pulses candidate positions relatively to the main pulse position is fundamental in determining the complexity as well as the required bit-rate.

For example, if the frame length is L and if the number of pulses in the main signal encoding is N, then one would need roughly N*log 2(L) bits to encode the pulse positions. However for encoding the side signal, if one retains only the main signal pulse positions as candidates, and the number of pulses in candidate excitation signals for the side signal is P, then one needs roughly P*log 2(N) bits. For reasonable numbers for N, P and L, this corresponds to quite a reduction in bit rate requirements.

One interesting aspect is when the pulse positions for the side signal are set equal to the pulse positions of the main signal. Then there is no encoding of the pulse positions needed and only encoding of the pulse amplitudes is needed. In the case of algebraic code books with pulses having +1/−1 amplitudes, then only the signs (N bits) need to be encoded.

If we denote by $P_M(i)$, i=1, . . . n, the main signal pulse positions. The pulse positions of candidate excitation signals for the side signal are selected based on the main signal pulse positions and possible additional parameters. The additional parameters may consist of time delay between the two channels and/or difference of adaptive codebook index.

Figure 3A:
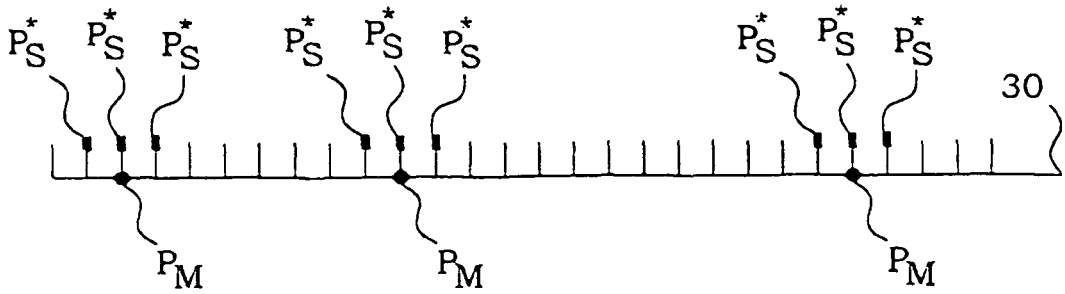
FIG. 3A is a diagram illustrating one example embodiment of a principle of selecting candidate excitation signals.

In this embodiment, the set of pulse positions for the side signal candidate excitation signal is constructed as $$\{P_M(i)+J(i,k),\ k=1,\ldots,k\max_i,\ i=1,\ldots,n\}$$

where J(i,k) denote some delay index. This means that each mono pulse position generate a set of pulse positions used for constructing the candidate excitation signals for the side signal pulse search procedure. This is illustrated in FIG. 3A. Here, $P_M$ denotes the pulse positions of the excitation signal for the main signal, and $P_S^n$ denotes possible pulse positions of the candidate excitation signals for the side signal analysis.

This of course is optimal with highly correlated signals. For low correlated or uncorrelated signals the inverse strategy would be adopted. This consists in taking the pulses candidates as all pulses not belonging to the set $$\{P_M(i)-J(i,k),\ k=1,\ldots,k\max_i,\ i=1,\ldots,n\}$$

Since this is a complementary case, it is easily understood by those skilled in the art that both strategies are similar and only the correlated case will be described in more detail.

It is easily seen that the position and number of pulse candidates is dependent on the delay index J(i,k). The delay index may be made dependent on the effective delay between the two channels and/or the adaptive codebook index. In FIG. 3A, k max=3, and $J(i,k)=J(k)\epsilon\{-1,0,+1\}$.

Figure 3B:
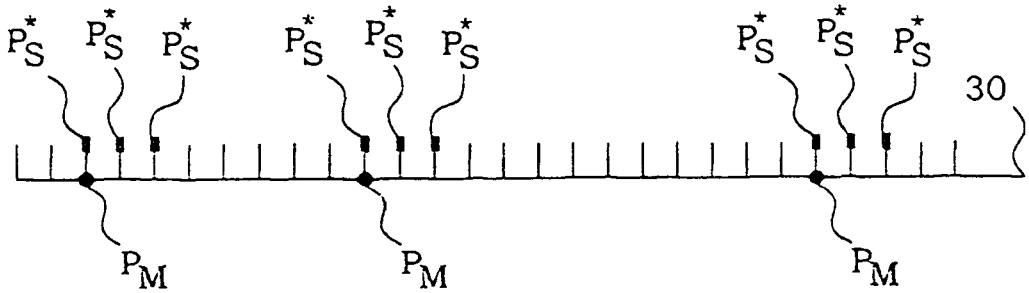
FIG. 3B is a diagram illustrating another example embodiment of a principle of selecting candidate excitation signals.

In FIG. 3B, another slightly different selection of pulse positions is made.

Here k max=3, but $J(i, k)=J(k)\epsilon\{0,+1,+2\}$.

Anyone skilled in the art realizes that the rules how to select the pulse positions can be constructed in many various manners. The actual rule to use may be adapted to the actual implementation. The important characteristics are, however, that the pulse positions candidates are selected dependent on the pulse positions resulting from the main signal analysis following a certain rule. This rule may be unique and fixed or may be selected from a set of predetermined rules dependent on e.g. the degree of correlation between the two channels and/or the delay between the two channels.

Dependent on the rule used, the set of pulse candidates of the side signal is constructed. The set of the side signal pulse candidates is in general very small compared to the entire frame length. This allows reformulating the objective maximization problem based on a decimated frame.

In the general case, the pulses are searched by using, for example, the depth-first algorithm described in [5] or by using an exhaustive search if the number of candidate pulses is really small. However, even with a small number of candidates it is recommended to use a fast search procedure.

A backward filtered signal is in general pre-computed using $$d^T=y_2{}^TH$$

The matrix $\Phi=H^TH$ is the matrix of correlations of h(n) (the impulse response of a weighting filter), elements of which are computed by $$\phi(i,\ j)=\sum_{i=j}^{L-1}h(l-i)h(l-j),\quad i=0,\ L-1,\quad j=0,\ \ldots\ ,\ L-1.$$

The objective function can therefore be written as $$Q_k=\frac{(d^Tc_k)^2}{c_k^T\Phi c_k}.$$

Given the set of possible candidate pulse positions on the side signal, only a subset of indices of the backward filtered vector d and the matrix $\Phi$ are needed. The set of candidate pulses can be sorted in ascending order $$\{P_M(i)+J(i,k),\ k=1,\ldots,k\max_i,\ i=1,\ldots,n\}=\{P_S{}^n(i),\ i=1,\ldots,p\}$$

$P_S{}^n(i)$ are the candidate pulses positions and p is their number. It should be noted that p is always less than, and typically much less than, the frame length L.

If we denote the decimated signal $$d_2(i)=d(P_S{}^n(i)),\ i=1,\ldots,p.$$

And the decimated correlations matrix $\Phi_2$ $$\phi_2(i,j)=\phi(P_S{}^n(i),P_S{}^n(j)),\ i=1,\ldots,p,\ j=1,\ldots,p$$

$\Phi_2$ is symmetric and is positive definite. We can directly write $$Q_k=\frac{(d^Tc_k)^2}{c_k^T\Phi c_k}=\frac{(d_2^Tc'_{k'})}{c'^T_{k'}\Phi_2c'_{k'}}.$$

where $c'_k$ is the new algebraic code vector. The index becomes k' which is a new entry in a reduced size codebook.

Figure 4:
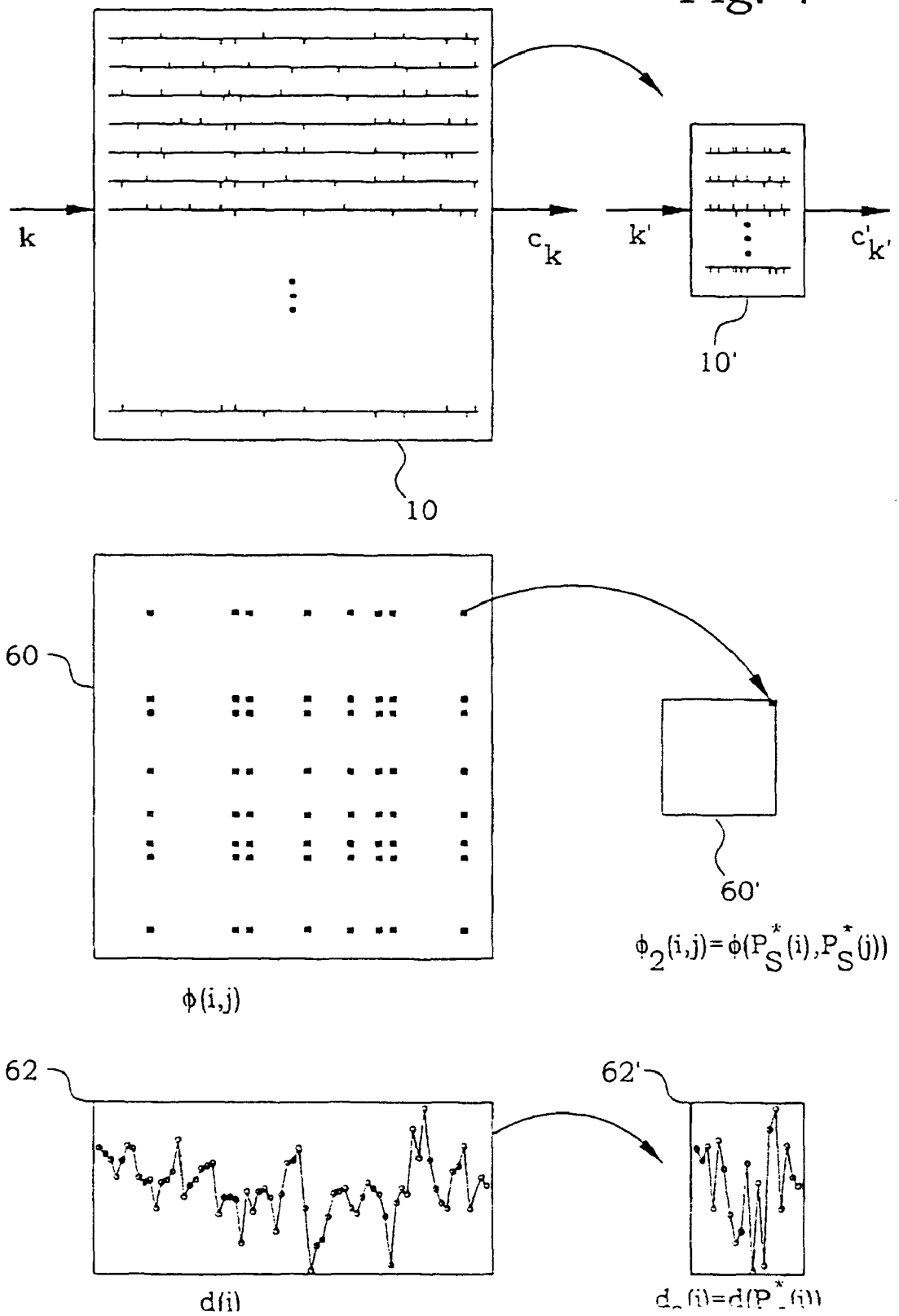
FIG. 4 illustrates a possibility to reduce required data entities according to an example embodiment.

The summary of these decimation operations is illustrated in FIG. 4. In the top of the figure, a reduction of an algebraic codebook 10 of ordinary size to a reduced size codebook 10' is illustrated. In the middle, a reduction of a weighting filter covariance matrix 60 of ordinary size to a reduced weighting filter covariance matrix 60' is illustrated. Finally, in the bottom part, a reduction of a backward filtered target 62 of ordinary size to a reduced size backward filtered target 62' is illustrated. Anyone skilled in the art realizes the reduction in complexity that is the result of such a reduction.

Maximizing the objective function on the decimated signals has several advantages. One of them is the reduction of memory requirements, for instance the matrix $\Phi_2$ needs lower memory. Another advantage is the fact that because the main signal pulse locations are in all cases transmitted to the receiver, the indices of the decimated signals are always available to the decoder. This in turn allows the encoding of the other signal (side) pulse positions relatively to the main signal pulse positions, which consumes much less bits. Another advantage is the reduction in computational complexity since the maximization is performed on decimated signals.

Figure 5A:
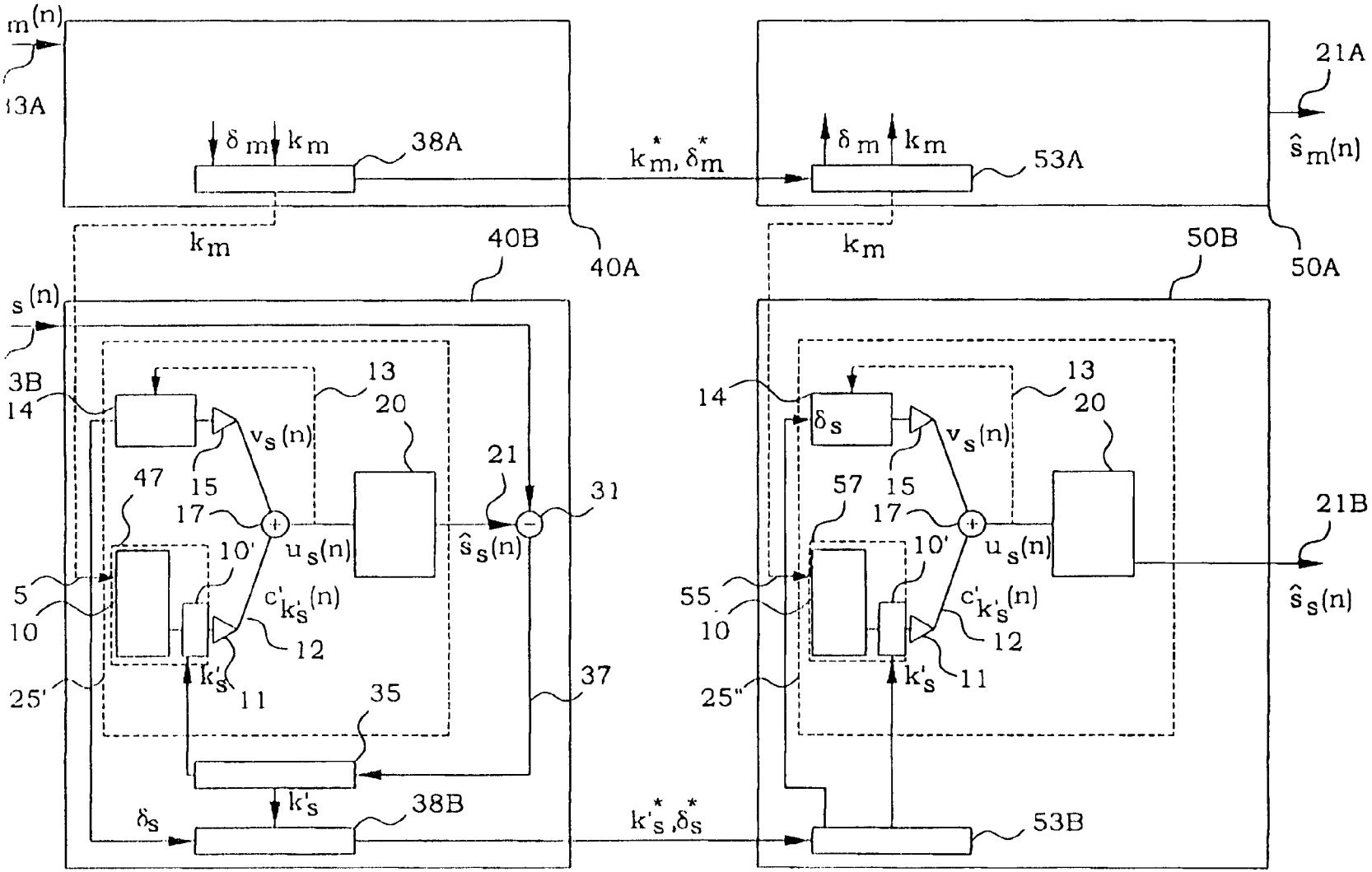
FIG. 5A is a block scheme of an example embodiment of encoders and decoders for two signals.

In FIG. 5A, an embodiment of a system of encoders 40A, 40B and decoders 50A, 50B according to the present invention is illustrated. Many details are similar as those illustrated in FIG. 2 and will therefore not be discussed in detail again, if their functions are essentially unaltered. A main signal 33A $s_m(n)$ is provided to a first encoder 40A. The first encoder 40A operates according to any prior art CELP encoding model, producing an index $k_m$ for the fixed codebook and a delay measure $\delta_m$ for the adaptive codebook. The details of this encoding are not of any importance for the present invention and is omitted in order to facilitate the understanding of FIG. 5A. The parameters $k_m$ and $\delta_m$ are encoded in a first index encoder 38A, giving representations $k^*_m$ and $\delta^*_m$ of the parameters that are sent to a first decoder 50A. In the first decoder, the representations $k^*_m$ and $\delta^*_m$ are decoded into parameters $k_m$ and $\delta_m$ in a first index decoder 53A. From these parameters, the original signal is reproduced according to any CELP decoding model according to prior art. The details of this decoding are not of any importance for the present invention and is omitted in order to facilitate the understanding of FIG. 5A. A reproduced first output signal 21A $\hat{s}_m(n)$ is provided.

A side signal 33B $s_s(n)$ is provided as an input signal to a second encoder 40B. The second encoder 40B is to most parts similar as the encoder of FIG. 2. The signals are now given an index "s" to distinguish them from any signals used for encoding the main signal. The second encoder 40B comprises a CELP synthesis block 25. According to the present invention, the index $k_m$ or a representation thereof is provided from the first encoder 40A to an input 45 of the fixed codebook 10 of the second encoder 40B. The index $k_m$ is used by a candidate deriving means 47 to extract a reduced fixed codebook 10' according to the above presented principles. The synthesis of the CELP synthesis block 25' of the second encoder 40B is thus based on indices $k'_s$ representing excitation signals $c'_{k'_s}(n)$ from the reduced fixed codebook 10'. An index $k'_s$ is thus found to represent a best choice of the CELP synthesis. The parameters $k'_s$ and $\delta_s$ are encoded in a second index encoder 38B, giving representations $k'^*_s$ and $\delta^*_s$ of the parameters that are sent to a second decoder 50B.

In the second decoder 50B, the representations $k'^*_s$ and $\delta^*_s$ are decoded into parameters $k'_s$ and $\delta_s$ in a second index decoder 53B. Furthermore, the index parameter $k_m$ is available from the first decoder 50A and is provided to the Input 55 of the fixed codebook 10 of the second decoder SOB, in order to enabling an extraction by a candidate deriving means 57 of a reduced fixed codebook 10' equal to what was used in the second encoder 40B. From the parameters $k'_s$ and $\delta_s$ and the reduced fixed codebook 10', the original side signal is reproduced according to ordinary CELP decoding models 25". The details of this decoding are performed essentially in analogy with FIG. 2, but using the reduced fixed codebook 10' instead. A reproduced side output signal 21B $\hat{s}_s(n)$ is thus provided.

Selection of the rule to construct the set of candidate pulses, e.g. the indexing function J(i,k), can advantageously be made adaptive and dependent on additional inter-channel characteristics, such as delay parameters, degree of correlation, etc. In this case, i.e. adaptive rule selection, the encoder has preferably to transmit to the decoder which rule has been selected for deriving the set of candidate pulses for encoding the other signal. The rule selection could for instance be performed by a closed-loop procedure, where a number of rules are tested and the one giving the best result finally is selected.

Figure 5B:
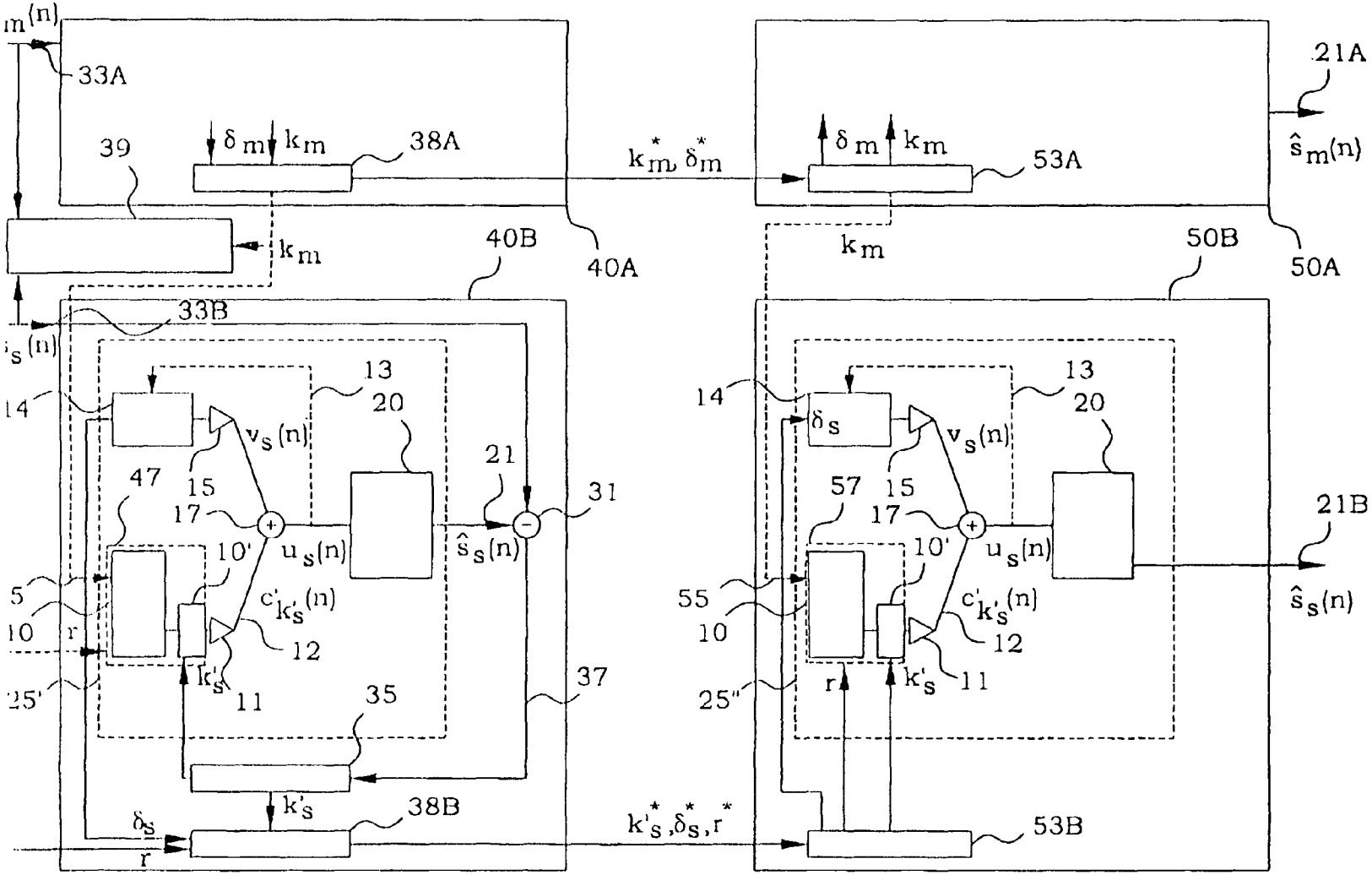
FIG. 5B is a block scheme of another example embodiment of encoders and decoders for two signals.

FIG. 5B illustrates an embodiment, using the rule selection approach. The mono signal $s_m(n)$ and preferably also the side signal $s_s(n)$ are here additionally provided to a rule selecting unit 39. Alternatively to the mono signal, the parameter $k_m$ representing the mono signal can be used. In the rule selection unit 39, the signals are analysed, e.g. with respect to delay parameters or degree of correlation. Depending on the results, a rule, e.g. represented by an index r is selected from a set of predefined rules. The index of the selected rule is provided to the candidate deriving means 47 for determining how the candidate sets should be derived. The rule index r is also provided to the second index encoder 38B giving a representation r* of the index, which subsequently is sent to the second decoder 50B. The second index decoder 53B decodes the rule index r, which then is used to govern the operation of the candidate deriving means 57.

In this manner, a set of rules can be provided, which will be suitable for different types of signals. A further flexibility is thus achieved, just by adding a single rule index in the transfer of data.

The specific rule used as well as the resulting number of candidate side signal pulses are the main parameters governing the bit rate and the complexity of the algorithm.

Figure 6:
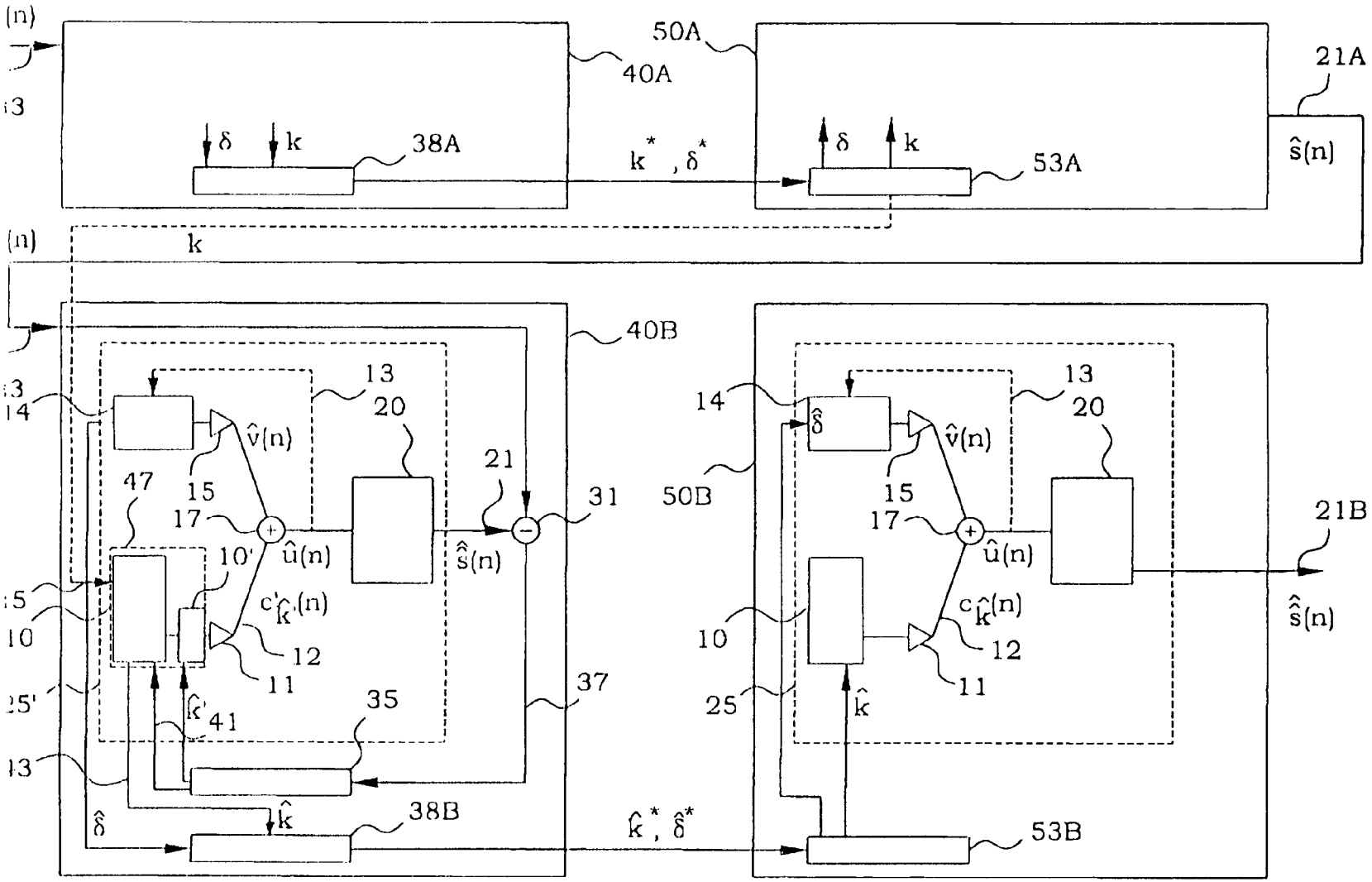
FIG. 6 is a block scheme of an example embodiment of encoders and decoders for re-encoding of a signal.

As stated further above, exactly the same principles could equally well be is applied for re-encoding of one and the same channel. FIG. 6 illustrates an embodiment, where different parts of a transmission path allows for different bit rates. It is thus applicable as part of a rate transcoding solution. A signal s(n) is provided as an input signal 33A to a first encoder 40A, which produces representations k* and δ* of parameters that are transmitted according to a first bit rate. At a certain place, the available bit rate is reduced, and a re-encoding for lower bit-rates has to be performed. A first decoder 50A uses the representations k* and δ* of parameters for producing a reproduced signal 21A $\hat{s}(n)$. This reproduced signal 21A $\hat{s}(n)$ is provided to a second encoder 40B as an input signal 33B. Also the index k from the first decoder 50A is provided to the second encoder 40B. The index k is in analogy with FIG. 6 used for extracting a reduced fixed codebook 10'. The second encoder 40B encodes the signal $\hat{s}(n)$ for a lower bit rate, giving an index $\hat{k}'$ representing the selected excitation signal $c'_{\hat{k}'}(n)$. However, this index $\hat{k}'$ is of little use in a distant decoder, since the decoder does not have the information necessary to construct a corresponding reduced fixed codebook. The index $\hat{k}'$ thus has to be associated with an index $\hat{k}$, referring to the original codebook 10. This is preferably performed in connection with the faxed codebook 10 and is represented in FIG. 6 by the arrows 41 and 43 illustrating the input of $\hat{k}'$ and the output of $\hat{k}$. The encoding of the index $\hat{k}$ is then performed with reference to a full set of candidate excitation signals.

In a typical case, a first encoding is made with a bit rate n and the second encoding is made with a bit rate m, where n>m.

Figure 7:
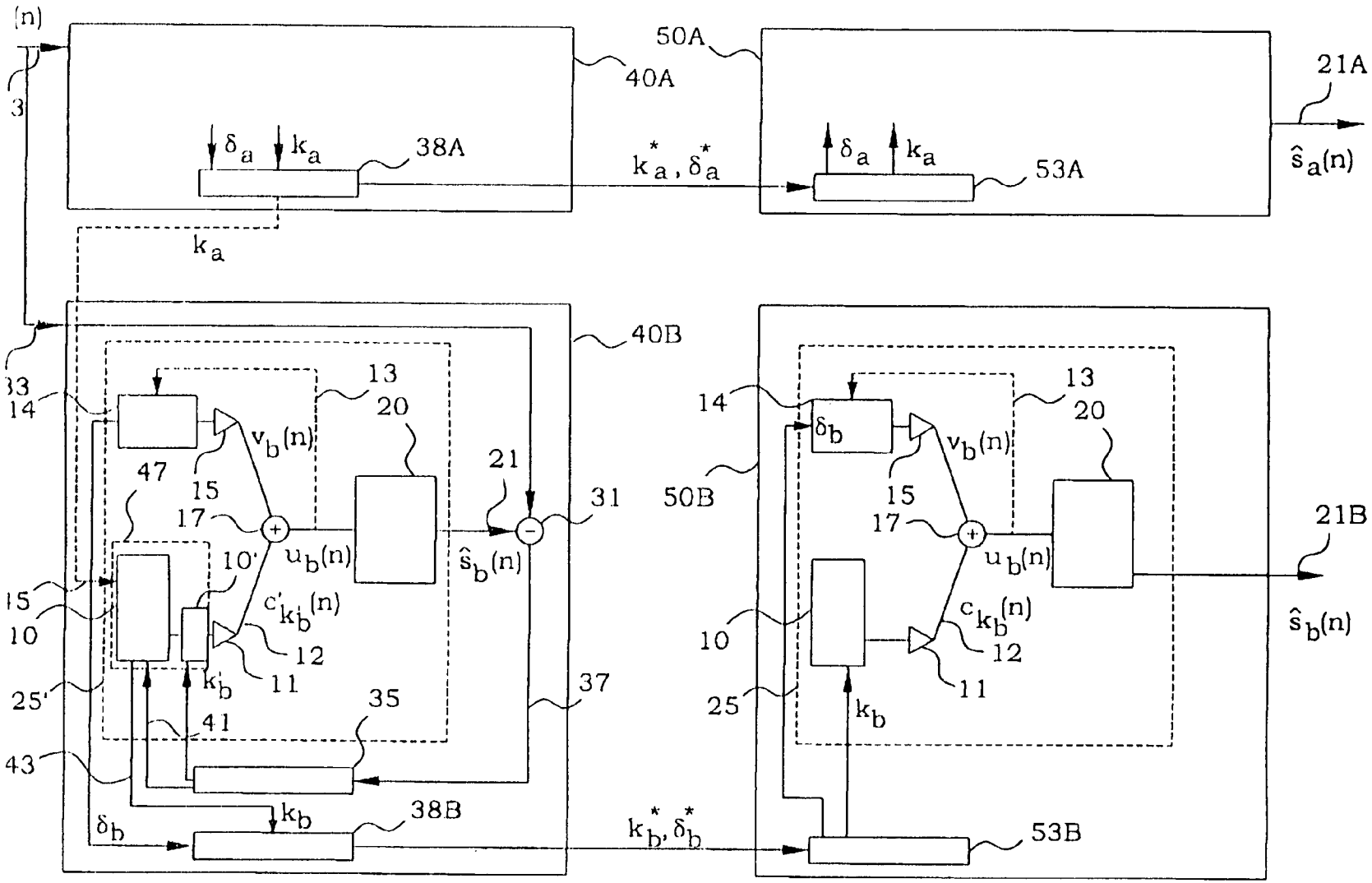
FIG. 7 is a block scheme of an example embodiment of encoders and decoders for parallel encoding of a signal for different bit rates.

In certain applications, for instance real-time transmission of live content through different types of networks with different capacities (for example teleconferencing), it may also be of interest to provide parallel encodings with differing bit rates, e.g. in situation where real time encoding of the same signal at several different bit-rates is needed in order to accommodate the different types of networks, so-called parallel multirate encoding. FIG. 7 illustrates a system, where a signal s(n) is provided to both a first encoder 40A and a second encoder 40B. In analogy with previous embodiments, the second encoder provides a reduced fixed codebook 10' based on an index $k_s$ representing the first encoding. The second encoding is here denoted by the index "b". The second encoder 40B thus becomes independent of the first decoder 50B. Most other parts are in analogy with FIG. 6, however, with adapted indexing.

For these two applications, re-encoding of the same signal at a lower rate, the technology disclosed herein offers a substantial reduction in complexity thus allowing the implementation of these applications with low cost hardware.

An embodiment of the above-described algorithm has been implemented in association with an AMR-WB speech codec. For encoding a side signal, the same adaptive codebook index is used as is used for encoding the mono excitation. The LTP gain as well as the innovation vector gain was not quantized.

The algorithm for the algebraic codebook was based on the mono pulse positions. As described in e.g. [6], the codebook may be structured in tracks. Except for the lowest mode, the number of tracks is equal to 4. For each mode a certain number of pulses positions is used. For example, for mode 5, i.e. 15.85 kbps, the candidate pulse positions are as follows

TABLE 1

Candidate pulse positions.

| Track | Pulse | Positions |
|---|---|---|
| 1 | $i_0, i_4, i_8$ | 0, 4, 8, 12, 16, 20, 24, 28, 32, 36, 40, 44, 48, 52, 56, 60 |
| 2 | $i_1, i_5, i_9$ | 1, 5, 9, 13, 17, 21, 25, 29, 33, 37, 41, 45, 49, 53, 57, 61 |
| 3 | $i_2, i_6, i_{10}$ | 2, 6, 10, 14, 18, 22, 26, 30, 34, 38, 42, 46, 50, 54, 58, 62 |
| 4 | $i_3, i_7, i_{11}$ | 3, 7, 11, 15, 19, 23, 27, 31, 35, 39, 43, 47, 51, 55, 59, 63 |

The implemented algorithm retains all the mono pulses as the pulse positions of the side signal, i.e. the pulse positions are not encoded. Only the signs of the pulses are encoded.

TABLE 2

Side and mono signal pulses.

| Track | Side signal pulse | Mono signal pulse |
|---|---|---|
| 1 | $p_0, p_4, p_8$ | $i_0, i_4, i_8$ |
| 2 | $p_1, p_5, p_9$ | $i_1, i_5, i_9$ |
| 3 | $p_2, p_6, p_{10}$ | $i_2, i_6, i_{10}$ |
| 4 | $p_3, p_7, p_{11}$ | $i_3, i_7, i_{11}$ |

Thus, each pulse will consume only 1 bit for encoding the sign, which leads to a total bit rate equal to the number of mono pulses. In the above example, there are 12 pulses per sub-frame and this leads to a total bit rate equal to 12 bits×4×50=2.4 kbps for encoding the innovation vector. This is the same number of bits required for the very lowest AMR-WB mode (2 pulses for the 6.6 kbps mode), but in this case we have higher pulses density.

It should be noted that no additional algorithmic delay is needed for encoding the stereo signal.

Figure 8:
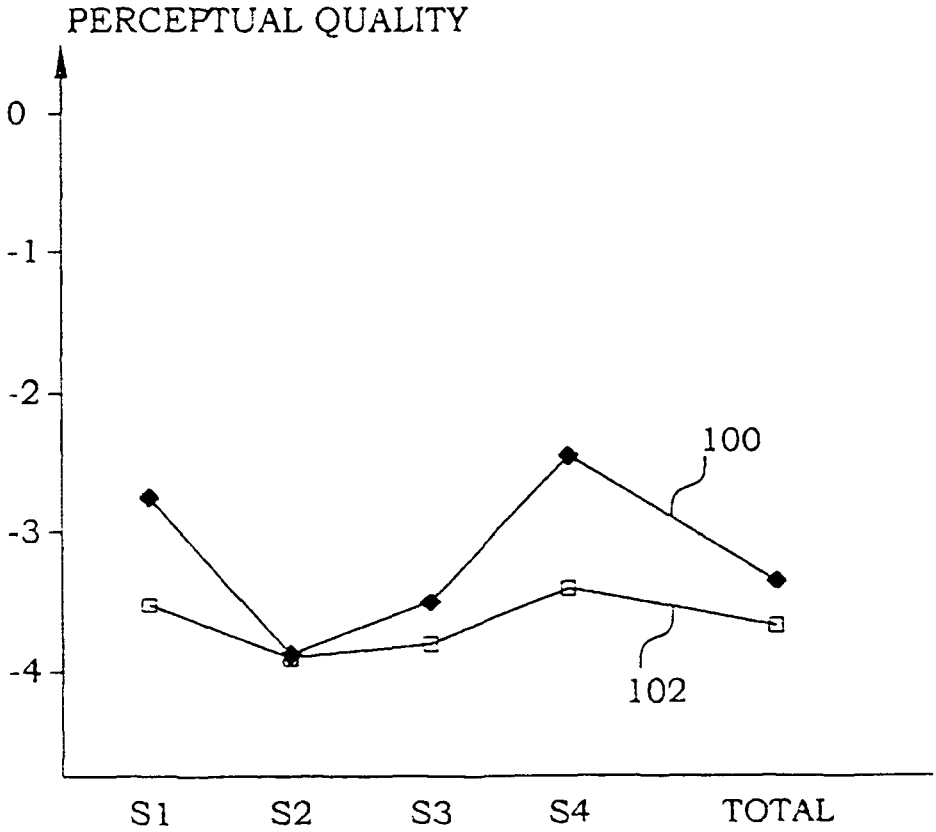
FIG. 8 is a diagram illustrating the perceptual quality achieved by example embodiments.

FIG. 8 shows the results obtained with PEAQ [4] for evaluating the perceptual quality. PEAQ has been chosen since to the best knowledge, it is the only tool that provides objective quality measures for stereo signals. From the results, it is clearly seen that the stereo 100 does in fact provide a quality lift with respect to the mono signal 102. The used sound items were quite various, sound 1, S1, is an extract from a movie with background noise, sound 2, S2, is a 1 min radio recording, sound 3, S3, a cart racing sport event, and sound 4, S4, is a real two microphone recoding.

Figure 9:
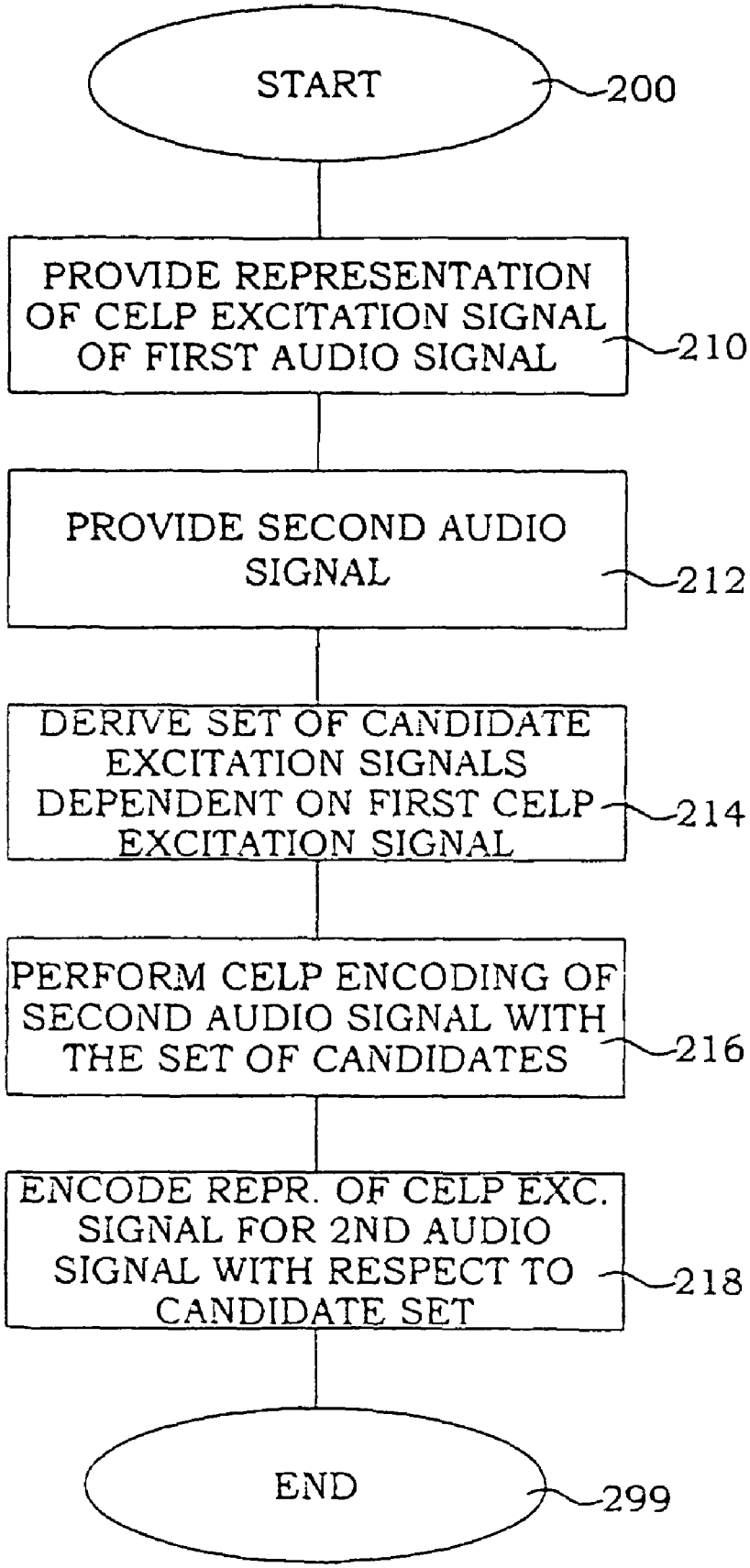
FIG. 9 is a flow diagram of steps of an example embodiment of an encoding method.

FIG. 9 illustrates an embodiment of an encoding method according to the technology disclosed herein. The procedure starts in step 200. In step 210, a representation of a CELP excitation signal for a first audio signal is provided. Note that it is not absolutely necessary to provide the entire first audio signal, just the representation of the CELP excitation signal. In step 212, a second audio signal is provided, which is correlated with the first audio signal. A set of candidate excitation signals is derived in step 214 depending on the first CELP excitation signal. Preferably, the pulse positions of the candidate excitation signals are related to the pulse positions of the CELP excitation signal of the first audio signal. In step 216, a CELP encoding is performed on the second audio signal, using the reduced set of candidate excitation signals derived in step 214. Finally, the representation, i.e. typically an index, of the CELP excitation signal for the second audio signal is encoded, using references to the reduced candidate set. The procedure ends in step 299.

Figure 10:
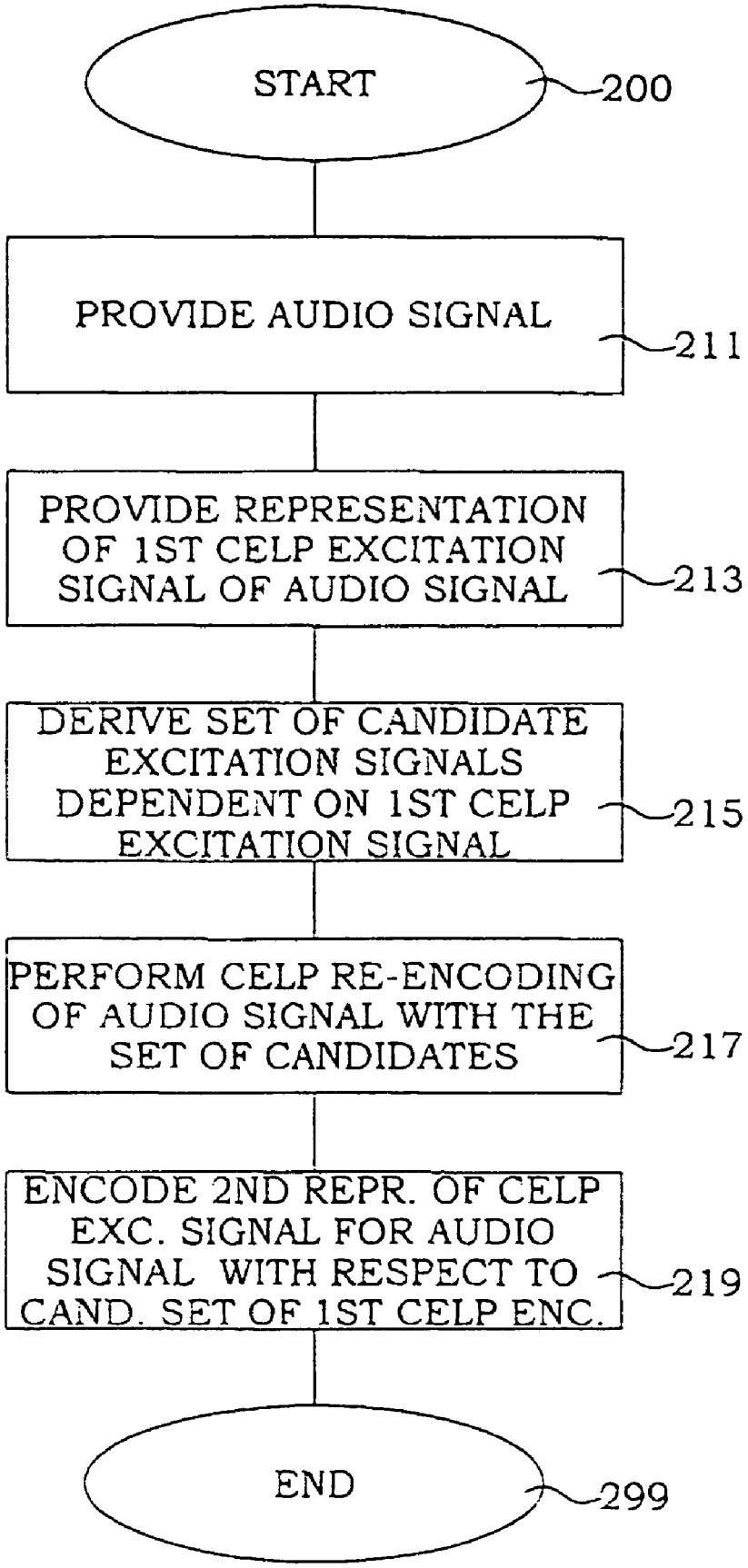
FIG. 10 is a flow diagram of steps of another example embodiment of an encoding method.

FIG. 10 illustrates another embodiment of an encoding method according to the technology disclosed herein. The procedure starts in step 200. In step 211, an audio signal is provided. In step 213, a representation of a first CELP excitation signal for the same audio signal is provided. A set of candidate excitation signals is decided in step 215 depending on the first CELP excitation signal. Preferably, the pulse positions of the candidate excitation signals are related to the pulse positions of the CELP excitation signal of the first audio signal. In step 217, a CELP re-encoding is performed on the audio signal, using the reduced set of candidate excitation signals derived in step 215. Finally, the representation, i.e. typically an index, of the second CELP excitation signal for the audio signal is encoded, using references to the non-reduced candidate set, i.e. the set used for the first CELP encoding. The procedure ends in step 299.

Figure 11:
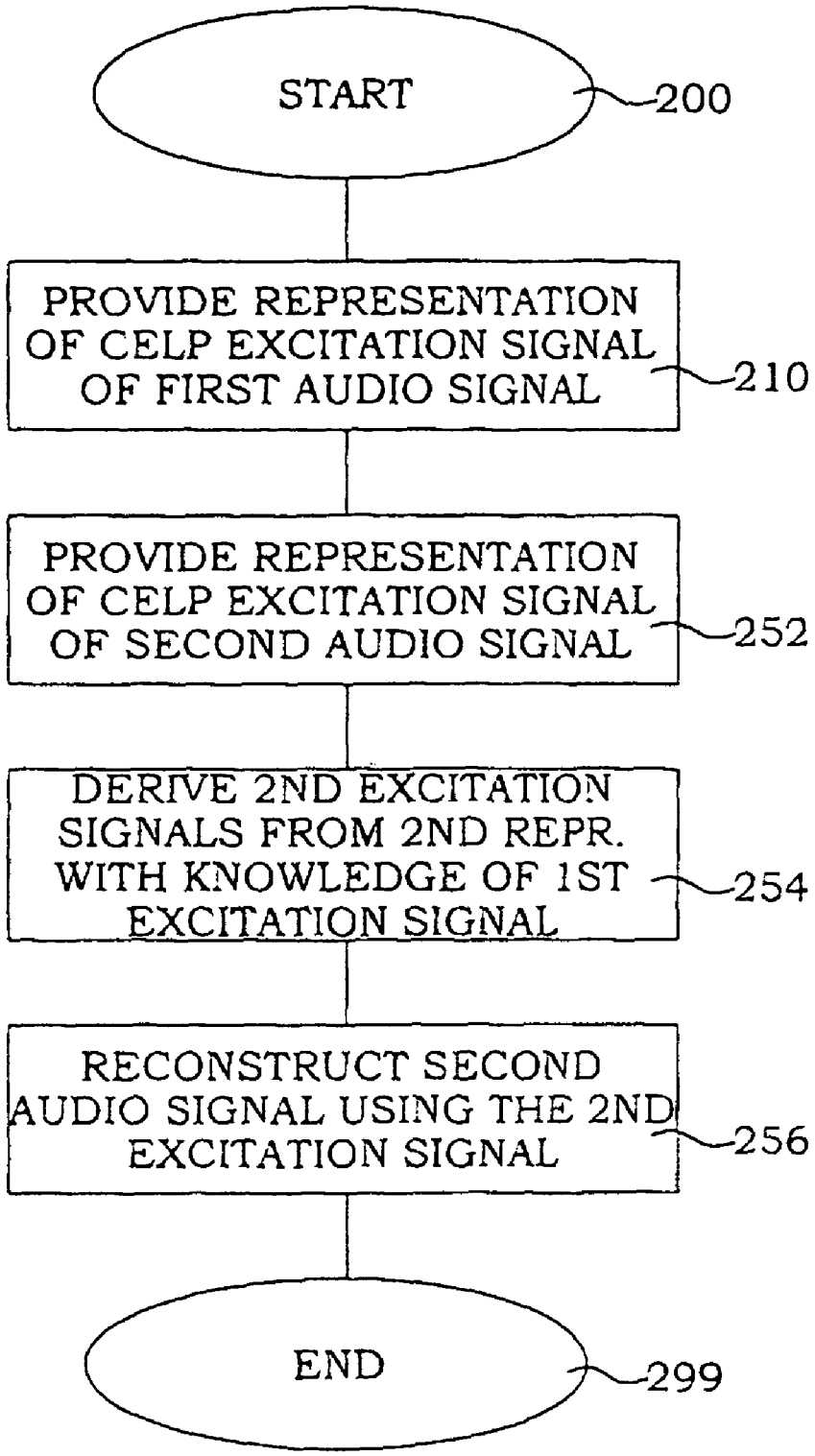
FIG. 11 is a flow diagram of steps of an example embodiment of a decoding method.

FIG. 11 illustrates an embodiment of a decoding method according to the technology disclosed herein. The procedure starts in step 200. In step 210, a representation of a first CELP excitation signal for a first audio signal is provided. In step 252, a representation of a second CELP excitation signal for a second audio signal is provided. In step 254, a second excitation signal is derived from the second excitation signal and with knowledge of the first excitation signal. Preferably, a reduced set of candidate excitation signals is derived defending on the first CELP excitation signal, from which a second excitation signal is selected by use of an index for the second CELP excitation signal. In step 256, the second audio signal is reconstructed using the second excitation signal. The procedure ends in step 299.

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible. The scope of the present invention is, however, defined by the appended claims.

The technology disclosed herein allows a dramatic reduction of complexity (both memory and arithmetic operations) as well as bit-rate when encoding multiple audio channels by using algebraic codebooks and CELP.

REFERENCES

[1] H. Fuchs, "Improving joint stereo audio coding by adaptive inter-channel prediction", in *Proc. IEEE WASPAA*, Mohonk, N.Y., October 1993.

[2] S. A. Ramprashad, "Stereophonic CELP coding using cross channel prediction", in *Proc. IEEE Workshop Speech Coding*, pp. 136-138, September 2000.

[3] T. Liebschen, "Lossless audio coding using adaptive multichannel prediction", in *Proc. AES* 113$^{th}$*Conv.*, Los Angeles, Calif., October 2002.

[4] ITU-R BS. 1387

[5] WO 96/28810.

[6] 3GPP TS 26.190, p. 28, table 7

[7] US 2004/0044524 A1

[8] US 2004/0109471 A1

[9] US 2003/0191635 A1

[10] U.S. Pat. No. 6,393,392 B1

The invention claimed is:

1. A method for encoding audio signals comprising:

providing, to an encoder, a representation of a first excitation signal of a first fixed codebook of a code excited linear prediction of a first audio signal of a time frame;

providing, to said encoder, a second audio signal of said time frame;

deriving, in said encoder, a set of candidate excitation signals, comprising a plurality of candidate excitation signals, as a second fixed codebook, said deriving of said set of candidate excitation signals is made based on said first excitation signal of said first fixed codebook of said time frame; and performing, in said encoder, a code excited linear prediction encoding of said second audio signal using a candidate excitation signal selected from said set of candidate excitation signals of said second fixed codebook.

2. A method according to claim 1, wherein said second audio signal is correlated to said first audio signal.

3. A method according to claim 1, wherein deriving said set of candidate excitation signals of said second fixed codebook comprises selecting a rule out of a predetermined set of rules based on said first excitation signal of said first fixed codebook and/or said second audio signal, whereby said set of candidate excitation signals is derived according to said selected rule.

4. A method according to claim 1, wherein said first excitation signal of said first fixed codebook has n pulse locations out of a set of N possible pulse locations;

said candidate excitation signals of said second fixed codebook has pulse locations only at a subset of said N possible pulse locations; and said subset of pulse locations is selected based on the n pulse locations of said first excitation signal of said first fixed codebook.

5. A method according to claim 4, wherein pulse locations of said subset of pulse locations are positioned at positions $p_j$, where index j is within intervals {i+L, i+K}, where i is an index of said n pulse locations, K and L are integers and K>L.

6. A method according to claim 5, wherein K=1 and L=−1.

7. A method according to claim 1, wherein said code excited linear prediction of said second audio signal is performed with a global search within said set of candidate excitation signals of said second fixed codebook.

8. A method according to claim 1, further comprising:

encoding a second excitation signal of said code excited linear prediction of said second audio signal with reference to said set of candidate excitation signals of said second fixed codebook; and providing said encoded second excitation signal together with said representation of said first excitation signal.

9. A method according to claim 8, wherein deriving said set of candidate excitation signals of said second fixed codebook comprises selecting a rule out of a predetermined set of rules based on said first excitation signal of said first fixed codebook and/or said second audio signal, whereby said set of candidate excitation signals of said second fixed codebook is derived according to said selected rule, said method comprising the further step of providing data representing an identification of said selected rule together with said representation of said first excitation signal.

10. A method according to claim 1, further comprising:

encoding a second excitation signal of said code excited linear prediction of said second audio signal with reference to a set of candidate excitation signals of said second fixed codebook having N possible pulse locations.

11. A method according to claim 10, wherein the second audio signal is the same as the first audio signal.

12. A method according to claim 1, wherein said first excitation signal has n pulse locations, and the second excitation signal has m pulse locations, where m<n.

13. A method for decoding of audio signals comprising:

providing, to a decoder, a representation of a first excitation signal of a first fixed codebook of a code excited linear prediction of a first audio signal of a time frame;

providing, to said decoder, a representation of a second excitation signal of a second fixed codebook of a code excited linear prediction of a second audio signal of said time frame;

said second excitation signal being one candidate excitation signal selected from said second fixed codebook of a set of candidate excitation signals comprising a plurality of candidate excitation signals;

said set of candidate excitation signals of said second fixed codebook being based on said first excitation signal;

deriving, in said decoder, said second excitation signal from said representation of said second excitation signal and based on information related to said set of candidate excitation signals of said second fixed codebook; and reconstructing, in said decoder, said second audio signal by prediction filtering said second excitation signal.

14. A method according to claim 13, wherein said second audio signal is correlated to said first audio signal.

15. A method according to claim 13, wherein said information related to said set of candidate excitation signals of said second fixed codebook comprises identification of a rule out of a pre-determined set of rules, said rule determining derivation of said set of candidate excitation signals of said second fixed codebook.

16. A method according to claim 13, wherein said first excitation signal of said first fixed codebook has n pulse locations out of a set of N possible pulse locations;

said candidate excitation signals of said second fixed codebook has pulse locations only at a subset of said N possible pulse locations; and said subset of pulse locations is selected based on the n pulse locations of said first excitation signal.

17. A method according to claim 16, wherein pulse locations of said subset of pulse locations are positioned at positions $p_j$, where index j is within intervals {i+L, i+K}, where i is an index of said n pulse locations, K and L are integers and K>L.

18. A method according to claim 17, wherein K=1 and L=−1.

19. An encoder for audio signals, comprising:

means for providing a representation of a first excitation signal of a first fixed codebook of a code excited linear prediction of a first audio signal of a time frame;

means for providing a second audio signal of said time frame;

means for deriving a set of candidate excitation signals, comprising a plurality of candidate excitation signals, as a second fixed codebook, connected to receive said representation of said first excitation signal, said set of candidate excitation signals of said second fixed codebook being based on said first excitation signal of said first fixed codebook; and means for performing a code excited linear prediction connected to receive said second audio signal and a representation of said set of candidate excitation signals of said second fixed codebook, said means for performing a code excited linear prediction being arranged for performing a code excited linear prediction of said second audio signal using a candidate excitation signal selected from said set of candidate excitation signals of said second fixed codebook.

20. An encoder according to claim 19, wherein said second audio signal is correlated to said first audio signal.

21. An encoder according to claim 19, wherein said means for deriving a set of candidate excitation signals of said second fixed codebook is arranged to select a rule out of a predetermined set of rules based on said first excitation signal of said first fixed codebook and/or said second audio signal and to derive said set of candidate excitation signals of said second fixed codebook according to said selected rule.

22. An encoder according to claim 19, wherein said first excitation signal of said first fixed codebook has n pulse locations out of a set of N possible pulse locations;

said candidate excitation signals of said second fixed codebook have pulse locations only at a subset of said N possible pulse locations; and said subset of pulse locations is selected based on the n pulse locations of said first excitation signal of said first fixed codebook.

23. An encoder according to claim 22, wherein pulse locations of said subset of pulse locations are positioned at positions $p_j$, where index j is within intervals {i+L, i+K}, where i is an index of said n pulse locations, K and L are integers and K>L.

24. An encoder according to claim 23, wherein K=1 and L=−1.

25. An encoder according to claim 19, wherein said means for performing code excited linear prediction of said second audio signal is arranged to perform a global search within said set of candidate excitation signals of said second fixed codebook.

26. An encoder according to claim 19, further comprising:

means for encoding a second excitation signal of said code excited linear prediction of said second audio signal with reference to said set of candidate excitation signals of said second fixed codebook; and means for providing said encoded second excitation signal together with said representation of said first excitation signal of said first fixed codebook.

27. An encoder according to claim 26, wherein said means for deriving a set of candidate excitation signals of said second fixed codebook is arranged to select a rule out of a predetermined set of rules based on said first excitation signal of said first fixed codebook and/or said second audio signal and to derive said set of candidate excitation signals of said second fixed codebook according to said selected rule; said encoder further comprising:

means for providing data representing an identification of said selected rule together with said representation of said first excitation signal of said first fixed codebook.

28. An encoder according to claim 19, further comprising:

means for encoding a second excitation signal of said code excited linear prediction of said second audio signal with reference to a set of candidate excitation signals of said second fixed codebook having N possible pulse locations.

29. An encoder according to claim 28, wherein the second audio signal is the same as the first audio signal, whereby said encoder is a re-encoder.

30. An encoder according to claim 19, wherein said first excitation , signal has n pulse locations, and the second excitation signal has m pulse locations, where m<n.

31. A decoder for audio signals, comprising:

means for providing a representation of a first excitation signal of a first fixed codebook of a code excited linear prediction of a first audio signal of a time frame;

means for providing a representation of a second excitation signal of a second fixed codebook of a code excited linear prediction of a second audio signal of said time frame;

said second excitation signal is one candidate excitation signal selected from said second fixed codebook of a set of candidate excitation signals comprising a plurality of candidate excitation signals;

said set of candidate excitation signals of said second fixed codebook is based on said first excitation signal of said first fixed codebook;

means for deriving said second excitation signal, connected to receive information associated with said representation of a first excitation signal of said first fixed codebook and said representation of said second excitation signal of said second fixed codebook, said means for deriving being arranged to derive said second excitation signal from said representation of a second excitation signal and based on information related to said set of candidate excitation signals of said second fixed codebook; and means for reconstructing said second audio signal by prediction filtering said second excitation signal.

32. A decoder according to claim 31, wherein said second audio signal is correlated to said first audio signal.

33. A decoder according to claim 31, wherein said information related to said set of candidate excitation signals of said second fixed codebook comprises identification of a rule out of a pre-determined set of rules, said rule determining derivation of said set of candidate excitation signals of said second fixed codebook.

34. A decoder according to claim 31, wherein said first excitation signal of said first fixed codebook has n pulse locations out of a set of N possible pulse locations;

said candidate excitation signals of said second fixed codebook have pulse locations only at a subset of said N possible pulse locations; and said subset of pulse locations is selected based on the n pulse locations of said first excitation signal of said first fixed codebook.

35. A decoder according to claim 34, wherein pulse locations of said subset of pulse locations are positioned at positions $p_j$, where index j is within intervals {i+L, i+K}, where i is an index of said n pulse locations, K and L are integers and K>L.

36. A decoder according to claim 35, wherein K=1 and L=−1.

* * * * *